US005080618A

United States Patent [19]

Dunham et al.

[11] Patent Number: 5,080,618

[45] Date of Patent: Jan. 14, 1992

[54] MARINE PROPULSION DEVICE COWL ASSEMBLY

[75] Inventors: William D. Dunham, Waukegan; Steven D. Burmeister, Grayslake, both of Ill.; H. Norman Petersen, Kenosha, Wis.; John A. Pierman, Waukegan, Ill.; Charles T. Rogan, Kenosha, Wis.; Louis R. Neal, Zion, Ill.

[73] Assignee: Outboard Marine Corporation, Waukegan, Ill.

[21] Appl. No.: 526,582

[22] Filed: May 18, 1990

[51] Int. Cl.[5] ..... B63H 21/26

[52] U.S. Cl. ..... 440/77; 440/87; 440/88

[58] Field of Search ..... 440/77, 88, 84, 86, 440/87; 123/195 P

[56] References Cited

U.S. PATENT DOCUMENTS

| | | | |
|---|---|---|---|
| 97,003 | 11/1869 | Brown . | |
| 1,308,582 | 7/1919 | Cronk . | |
| 2,798,470 | 7/1957 | Kiekhaefer | 123/198 |
| 2,815,742 | 12/1957 | Kiekhaefer | 123/198 |
| 2,839,042 | 6/1958 | Armstrong et al. | 123/198 |
| 2,914,133 | 11/1959 | Johnson | 181/53 |
| 3,195,530 | 7/1965 | Heidner | 123/198 |
| 3,204,619 | 9/1965 | Rubinowitz et al. | 123/74 |
| 3,358,668 | 12/1967 | Post et al. | 123/198 |
| 3,557,902 | 1/1971 | Brown | 181/35 |
| 3,610,198 | 10/1971 | Alexandrowicz | 115/17 |
| 3,712,416 | 1/1973 | Swanson et al. | 181/35 A |
| 3,773,010 | 11/1973 | Elingsen | 115/17 |
| 3,810,526 | 5/1974 | Kawasaki | 181/35 A |
| 3,933,114 | 1/1976 | Horn | 115/17 |
| 3,949,726 | 4/1976 | List | 123/198 E |
| 4,136,756 | 1/1979 | Kawamura | 181/229 |
| 4,142,607 | 3/1979 | Landwehr et al. | 181/259 |
| 4,254,746 | 3/1981 | Chiba et al. | 123/52 M |
| 4,326,600 | 4/1982 | Okazaki et al. | 181/229 |
| 4,348,194 | 9/1982 | Walsh | 440/77 |
| 4,354,458 | 10/1982 | Bury | 123/52 M |
| 4,379,702 | 4/1983 | Takada et al. | 440/77 |
| 4,403,971 | 9/1983 | Kobayashi et al. | 440/88 |
| 4,403,972 | 9/1983 | Bland et al. | 440/88 |
| 4,518,363 | 5/1985 | Bland | 440/77 |
| 4,522,602 | 6/1985 | Okazaki | 440/77 |
| 4,620,607 | 11/1986 | Breckenfeld et al. | 181/229 |
| 4,708,673 | 11/1987 | Dunham et al. | 440/77 |
| 4,800,854 | 1/1989 | Boda et al. | 440/77 X |
| 4,844,650 | 7/1989 | Zapushek et al. | 403/197 |

FOREIGN PATENT DOCUMENTS

| | | | |
|---|---|---|---|
| 241400 | 11/1960 | Australia . | |
| 56-157694 | 12/1981 | Japan . | |
| 57-41291 | 3/1982 | Japan . | |
| 105896 | 6/1983 | Japan | 440/77 |
| 58-194693 | 11/1983 | Japan . | |
| 58-194695 | 11/1983 | Japan . | |
| 59-120598 | 11/1984 | Japan . | |
| 20794 | 1/1987 | Japan | 440/77 |
| 128899 | 6/1987 | Japan | 440/87 |

*Primary Examiner*—Sherman Basinger
*Attorney, Agent, or Firm*—Michael, Best & Friedrich

[57] ABSTRACT

A marine propulsion device comprising a lower unit, a propeller shaft rotatably supported by the lower unit and adapted to support a propeller, an engine supported by the lower unit and drivingly connected to the propeller, the engine including an engine block, and a throttle arm movably mounted on the engine block, a control cable operably connected to the throttle arm, a mechanism for removably securing the control cable to the engine block, and a cowl assembly surrounding the engine and including a pan-like lower cover member and a dome-shaped upper cover member, one of the cover members having therein an access opening affording access to the mechanism for securing the control cable to the engine block, and an access cover removably secured to the cover member in covering relation to the access opening.

23 Claims, 6 Drawing Sheets

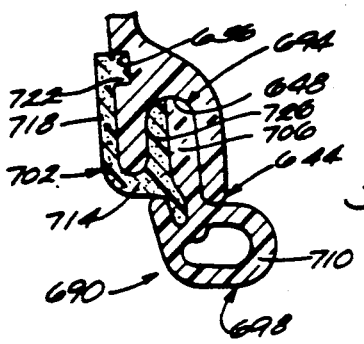
Fig. 20
Fig. 13
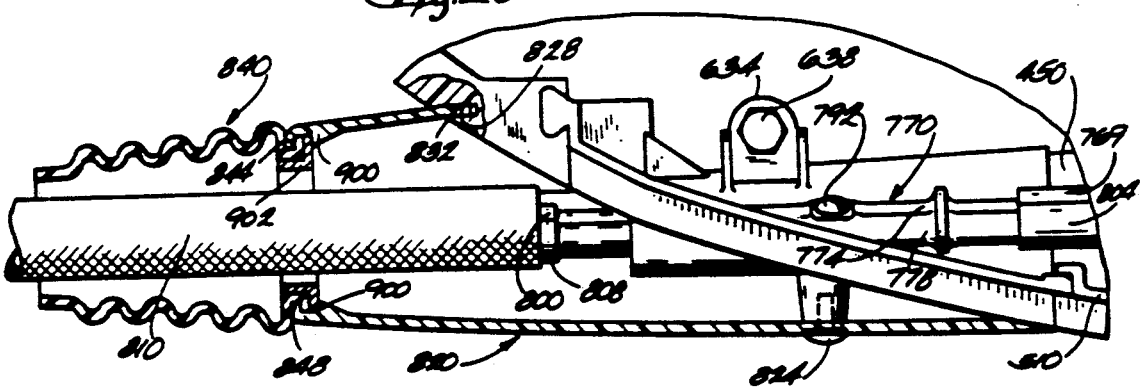

MARINE PROPULSION DEVICE COWL ASSEMBLY

BACKGROUND OF THE INVENTION

The invention relates to marine propulsion devices, and more particularly to outboard motors. Still more particularly, the invention relates to outboard motor cowl assemblies.

Attention is directed to the following U.S. Patents:

| | | |
|---|---|---|
| Brown | 97,033 | Nov. 23, 1869 |
| Cronk | 1,308,582 | July 1, 1919 |
| Horn | 3,933,114 | Jan. 20, 1976 |
| Dunham, et al. | 4,708,673 | Nov. 24, 1987 |
| Zapushek, et al. | 4,844,650 | July 4, 1989 |

SUMMARY OF THE INVENTION

The invention provides a marine propulsion device comprising a lower unit, a propeller shaft rotatably supported by the lower unit and adapted to support a propeller, an engine supported by the lower unit and drivingly connected to the propeller, the engine including an engine block, and a throttle arm movably mounted on the engine block, a control cable operably connected to the throttle arm, means for removably securing the control cable to the engine block, and a cowl assembly surrounding the engine and including a pan-like lower cover member and a dome-shaped upper cover member, one of the cover members having therein an access opening, and means for affording access to the means for securing the control cable to the engine block, the affording means including the access opening, and an access cover removably secured to the cover member in covering relation to the access opening.

The invention also provides a marine propulsion device comprising a lower unit, a propeller shaft rotatably supported by the lower unit and adapted to support a propeller, an engine supported by the lower unit and drivingly connected to the propeller, a cowl assembly surrounding the engine and including a pan-like lower cover member having therein a drain opening, and a U-shaped drain conduit including a lower portion, a first leg extending upwardly from the lower portion and communicating with the drain opening, and a second leg extending upwardly from the lower portion and communicating with the atmosphere.

The invention also provides a marine propulsion device comprising a lower unit, a propeller shaft rotatably supported by the lower unit and adapted to support a propeller, an engine supported by the lower unit and drivingly connected to the propeller, an electrical cable operably connected to the engine, a cowl assembly surrounding the engine and including a first section which is mounted on the lower unit and which has therein an opening through which the electrical cable extends, and a second section located in the opening, and means for removably securing the second section to the first section so as to clamp the electrical cable between the first and second sections.

The invention also provides a marine propulsion device comprising a lower unit, a propeller shaft rotatably supported by the lower unit and adapted to support a propeller, an engine supported by the lower unit and drivingly connected to the propeller, a cowl assembly surrounding the engine and including a first section which is mounted on the lower unit and which has therein an opening, and a second section which is located in the opening and which has therein an aperture, means for removably securing the second section to the first section, a fluid conduit extending through the aperture and having an inner end located inside the cowl assembly and an outer end located outside the cowl assembly, means for removably securing the fluid conduit to the second section of the cowl assembly, an inner hose connected between the engine and the inner end of the conduit, and an outer hose connected to the outer end of the conduit.

The invention also provides a marine propulsion device comprising a lower unit, a propeller shaft rotatably supported by the lower unit and adapted to support a propeller, an engine supported by the lower unit and drivingly connected to the propeller, an electrical cable operably connected to the engine, a cowl assembly surrounding the engine and including a first section which is mounted on the lower unit and which has therein an opening through which the electrical cable extends, and a second section which is located in the opening and which has therein first and second apertures, means for removably securing the second section to the first section so as to clamp the electrical cable between the first and second sections, a fuel and oil conduit assembly including a fuel conduit extending through the first aperture and having an inner end located inside the cowl assembly and an outer end located outside the cowl assembly, and an oil conduit extending through the second aperture and having an inner end located inside the cowl assembly and an outer end located outside the cowl assembly, means for removably securing the fuel and coil conduit assembly to the second section of the cowl assembly, an inner fuel hose connected between the engine and the inner end of the fuel conduit, an outer fuel hose connected to the outer end of the fuel conduit, an inner oil hose connected between the engine and the inner end of the oil conduit, an outer oil hose connected to the outer end of the oil conduit, a rigid duct extending exteriorly of the cowl assembly and surrounding the electrical cable, the outer fuel hose, and the outer oil hose, means for removably securing the duct to the second section, a flexible bellows surrounding the electrical cable, the outer fuel hose, and the outer oil hose, and means for removably securing the bellows to the duct.

Other features and advantages of the invention will become apparent to those skilled in the art upon review of the following detailed description, claims and drawings.

DESCRIPTION OF THE DRAWINGS

FIG. 13 is a view taken along line 13—13 in FIG. 11.

FIG. 19 is a view taken along line 19—19 in FIG. 17.

FIG. 20 is an enlarged sectional view of the seal.

Figure 1:
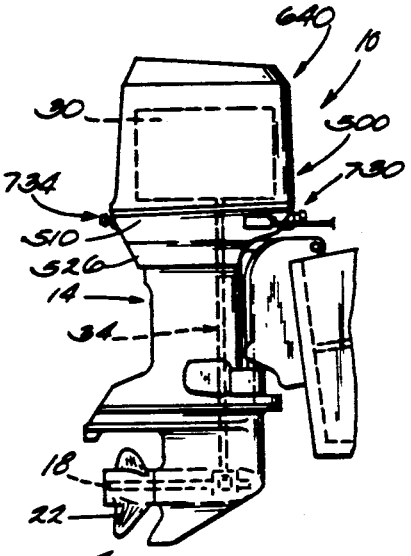
FIG. 1 is a side elevational view of a marine propulsion device embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A marine propulsion device 10 embodying the invention is illustrated in the drawings. The marine propulsion device 10 is preferably an outboard motor comprising (see FIG. 1) a lower unit 14, and a propeller shaft 18 which is rotatably supported by the lower unit and which supports a propeller 22. The marine propulsion device further comprises an internal combustion engine 30 supported by the lower unit and drivingly connected to the propeller shaft by a conventional drive train 34.

The engine 30 is preferably identical to the engine disclosed in U.S. Pat. Ser. No. 525,746, filed May 18, 1990 which was filed concurrently herewith and which is incorporated herein by reference. The engine 30 includes an engine block 40, and a throttle arm 360 pivotally mounted on the engine block.

Figure 5:
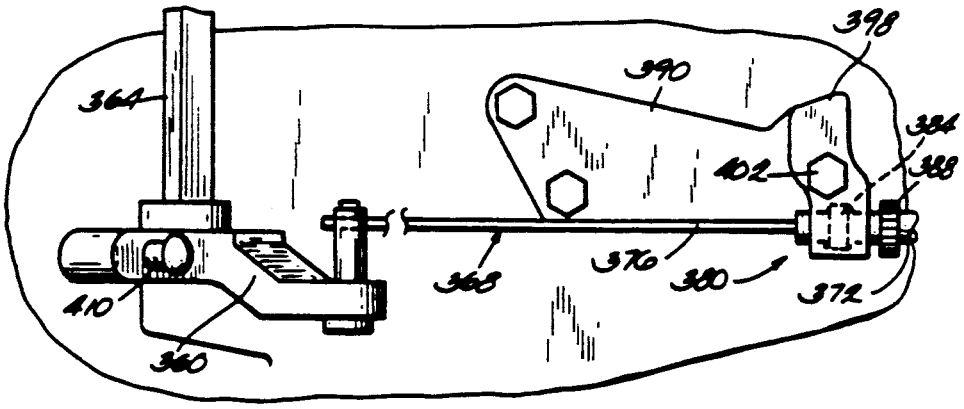
FIG. 5 is a further enlarged, partial elevational view of the engine as shown in FIG. 2.
Figure 8:
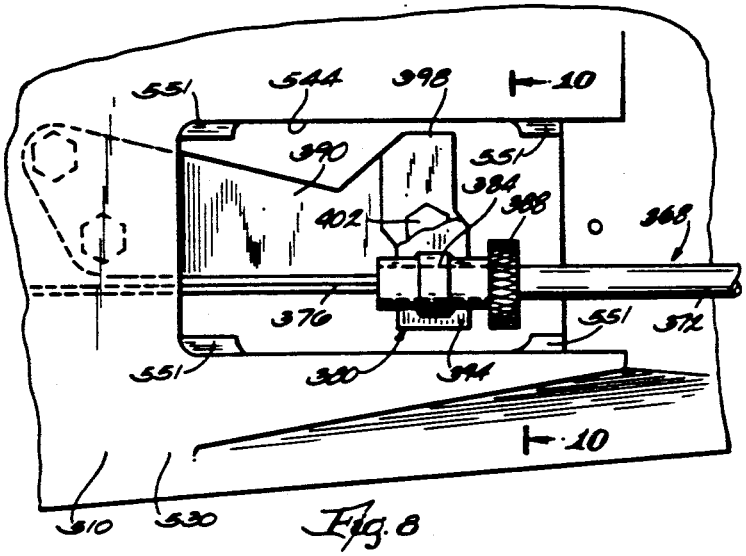
FIG. 8 is a view similar to FIG. 7 with the access cover and grommet removed.
Figure 10:
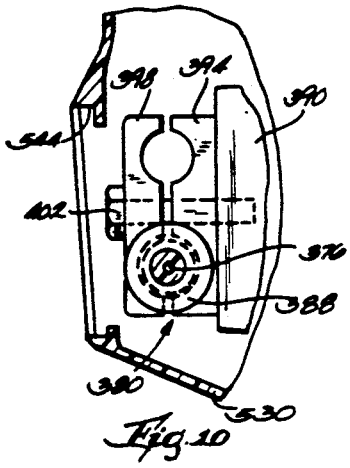
FIG. 10 is a view taken along line 10—10 in FIG. 8.
Figure 7:
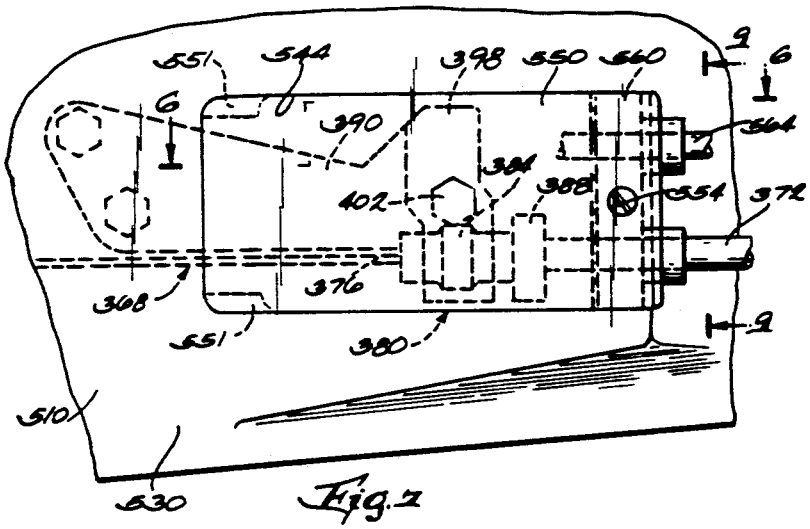
FIG. 7 is a view taken along line 7—7 in FIG. 6.
Figure 9:
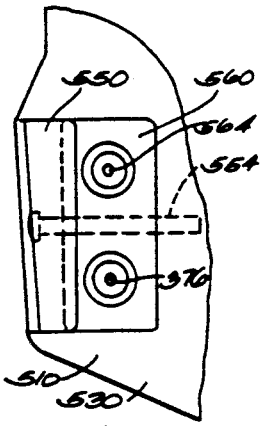
FIG. 9 is a view taken along line 9—9 in FIG. 7.
Figure 6:
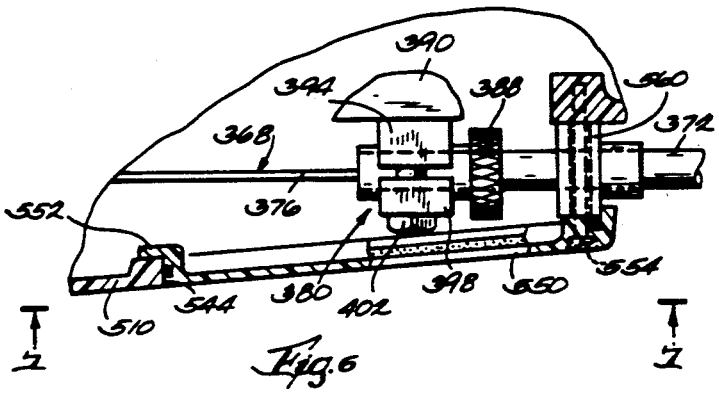
FIG. 6 is a view taken along line 6—6 in FIGS. 2 and 7.

The marine propulsion device also comprises (see FIG. 5) a control cable 368 having one end operably connected to the throttle arm 360. The cable 368 preferably includes an externally threaded outer sheath 372, and an inner core 376 slideably housed within the outer sheath. The core 376 is connected to the throttle arm for pivoting the throttle arm 360 in response to movement of the core 376 relative to the sheath 372. The cable 368 also includes (see FIGS. 6–8) a trunnion 380 threaded onto the outer sheath 372 such that rotation of the trunnion 380 relative to the sheath 372 causes axial movement of the trunnion 380 relative to the sheath 372. The trunnion 380 includes an enlarged portion 384 and also includes a knurled knob portion 388 dimensioned and shaped to be easily grasped and rotated by an operator's fingers.

The marine propulsion device 10 further comprises (see FIGS. 5–8) means for removably securing the control cable 368 to the engine block 40. While various suitable securing means can be employed, in the preferred embodiment, the engine 30 also includes a cable support arm 390 mounted on and extending forwardly from the engine block 40, and such means removably secures the cable sheath 372 to the cable support arm 390. The securing means includes a trunnion block 394 fixed to the cable support arm 390, and a trunnion block cover 398 removably secured to the trunnion block 394 so as to capture the enlarged portion of the trunnion 380 between the trunnion block cover 398 and the trunnion block 394. The trunnion block cover 398 is preferably removably secured to the trunnion block 394 by a screw 402. Engagement of the trunnion 380 by the trunnion block 394 and trunnion block cover 398 prevents axial movement of the trunnion 380 relative to the trunnion block 394 while permitting rotation of the trunnion 380 relative to the trunnion block 394. Rotation of the trunnion 380 relative to the trunnion block 394 and relative to the cable sheath 372 causes axial movement of the sheath 372 relative to the trunnion block 394 and thus relative to the engine block 40. Accordingly, the position of the cable sheath 372 relative to the engine block 40 is adjusted by rotating the trunnion 380.

The opposite end of the cable 368 is operably connected to a remote control device (not shown). The remote control device is preferably a single lever control and includes a control lever movable between forward, neutral and reverse positions. The remote control device moves the cable core 376 relative to the cable sheath 372 so as to move the throttle arm 360 from its closed position to its open position in response to movement of the control lever from neutral to either forward or reverse. Other types of remote control devices (e.g., not single lever controls) can also be employed.

The marine propulsion device 10 further comprises (see FIG. 16) an electrical cable 450 operably connected to the engine 30. Such an arrangement is known in the art and will not be described in greater detail.

Figure 2:
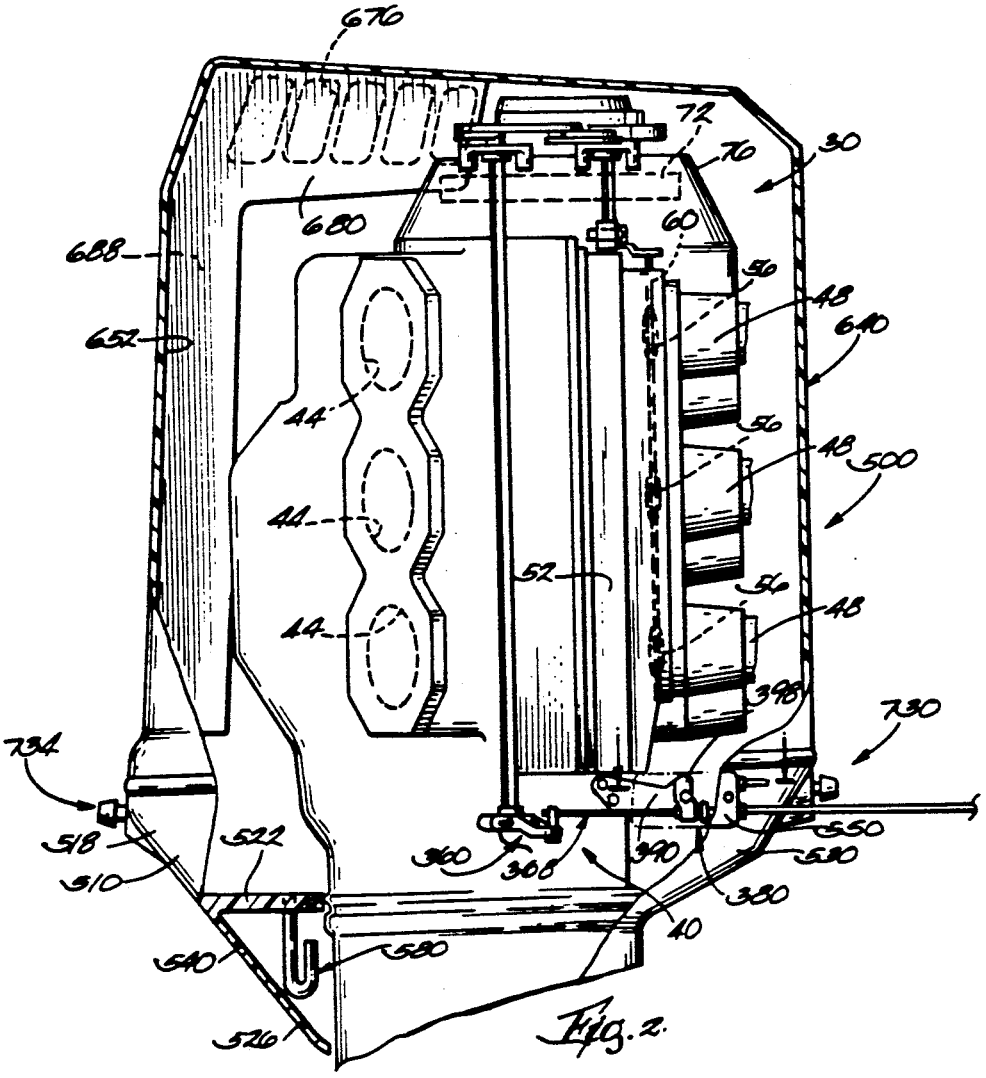
FIG. 2 is a partial elevational view, partially in section, of the marine propulsion device as shown in FIG. 1.

The marine propulsion device 10 further comprises (see FIGS. 1 and 2) a cowl assembly 500 surrounding the engine. The cowl assembly 500 includes (see FIG. 2) a pan-like lower cover member 510 having an endless upper end 514 and including an endless side wall 518, an endless bottom wall 522 sealingly engaging the lower unit, and a skirt 526 which depends from the bottom wall 522 and which is spaced from the lower unit. The lower cover member 510 is preferably formed of starboard and port halves 530 and 540, respectively, which are, except as described below, substantially mirror images of each other. The halves 530 and 540 of the lower cover member 510 are preferably mounted on the lower unit 14 in the manner described in U.S. Pat. No. 4,708,673, which is incorporated herein by reference.

The starboard half 530 of the lower cover member 510 includes (see FIGS. 2 and 6–8) means for affording access to the means for securing the control cable 368 to the engine block 40, i.e., for affording access to the trunnion block cover 398. While various suitable affording means can be used, in the preferred embodiment, such means includes (see FIGS. 6–8) an access opening 544 in the starboard half 530 of the lower cover member 510, and an access cover 550 removably secured to the starboard half 530 of the lower cover member 510 in covering relation to the access opening 544. The starboard half 530 has thereon upper and lower tabs 551 which engage the cover 550 and prevent the cover 550 from moving into the cowl assembly 500 (upwardly in FIG. 6), and the cover 550 has thereon a projection 552 which engages the inner surface of the lower cover member 510 and prevents the cover 550 from moving outwardly (downwardly in FIG. 6) from the lower cover member 510 when the projection 552 is in overlapping engagement with the lower cover member 510. The access cover 550 is preferably removably secured to the starboard half 530 of the lower cover member 510 by a screw 554, and by the tabs 551 and the projection 552. The starboard half 530 also includes a flexible grommet 560 through which the throttle control cable 368 and a shift control cable 564 (partially shown) extend. The grommet 560 is located in the access opening 544 and is clamped between the access cover 550 and the starboard half 530. Preferably, the screw 554 extends through the grommet 560 and into the starboard half 530.

Figure 3:
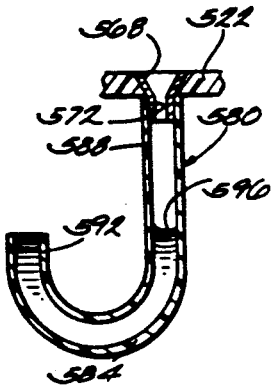
FIG. 3 is a view which is taken along line 3—3 in FIG. 2 and which shows a J-shaped conduit when the engine is idling or is not operating.
Figure 4:
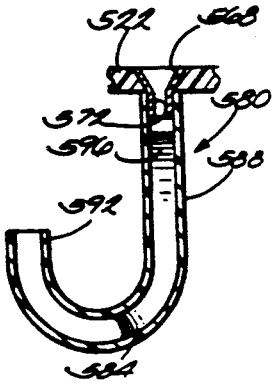
FIG. 4 is a view similar to FIG. 3 showing the J-shaped conduit when the engine is at wide open throttle.

The port half 540 of the lower cover member 510 includes (see FIGS. 2–4) a drain opening 568 in the bottom wall 522, and a nipple 572 communicating with the drain opening 568 and extending downwardly from the bottom wall 522. The port half 540 also includes a U-shaped drain conduit 580 including a lower portion 584, a first leg 588 extending upwardly from the lower portion 584 and communicating with the nipple 572, and a second leg 592 extending upwardly from the lower portion 584 and communicating with the space between the skirt 526 and the lower unit 14 (and thus with the atmosphere). The second leg 592 is preferably shorter than the first leg 588, and the upper end of the second leg 592 is spaced beneath the bottom wall 522 of the lower cover member 510. The conduit 580 is located between the skirt 526 and the lower unit 14, and water flowing out of the conduit 580 flows between the skirt 526 and the lower unit 14 to the atmosphere. The conduit 580 functions somewhat like the trap in the drain pipe of a sink. Water becomes trapped in the lower portion 584 of the conduit 580 and forms a "plug" 596 which prevents water spray and splash from being sucked into the cowl assembly 500 through the conduit 580. When the engine 30 is not operating or is idling, the plug 596 is located in the lower portion 584 of the conduit 580 as shown in FIG. 3. When the engine 30 is operating at wide open throttle, as shown in FIG. 4, a vacuum of approximately 1.5 inches of water is formed inside the cowl assembly 500, and this causes the plug 596 to move approximately 1.5 inches upwardly in the first leg 588 of the conduit 580, but not into the cowl assembly 500.

Figure 11:
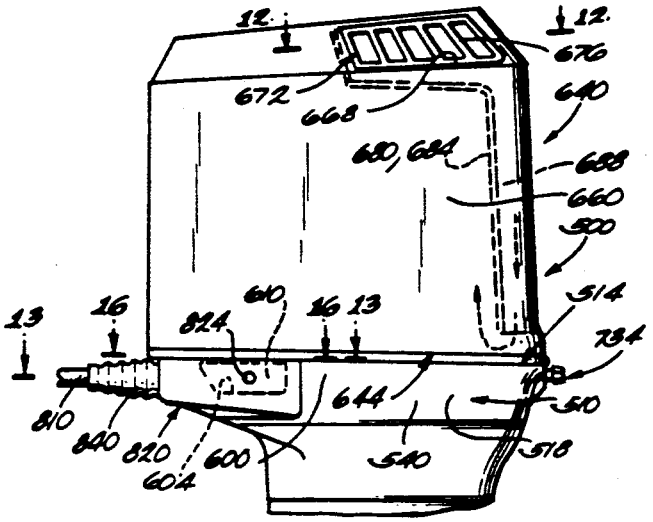
FIG. 11 is a partial elevational view of the opposite side of the marine propulsion device as shown in FIG. 1.
Figure 12:
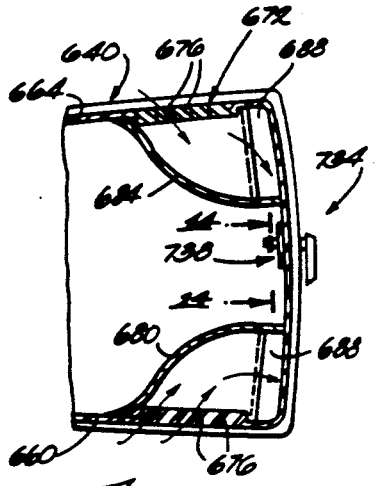
Figure 16:
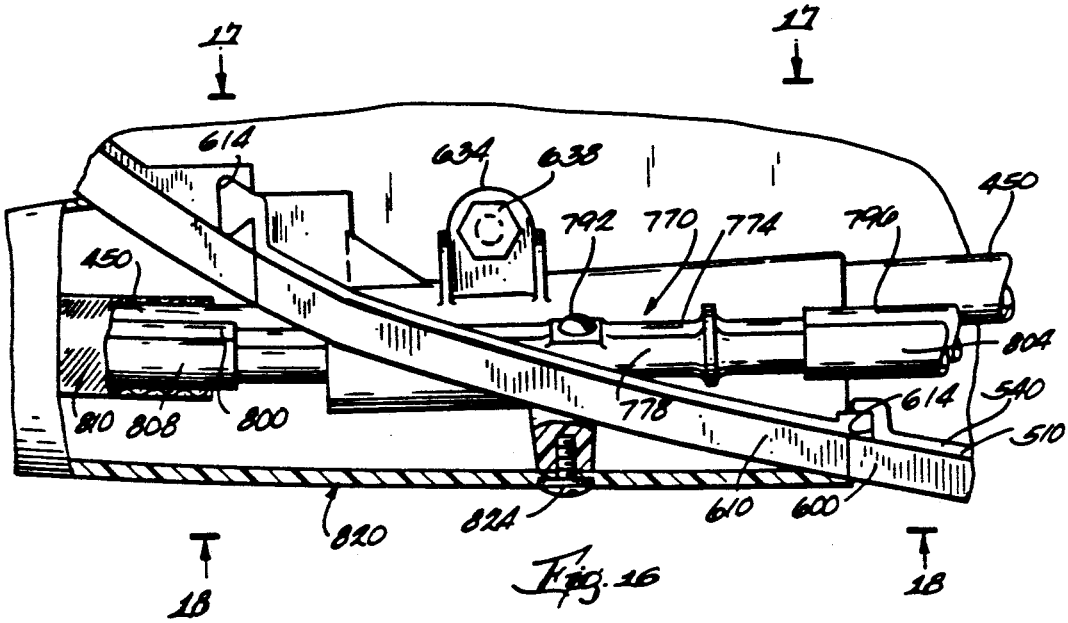
FIG. 16 is a view taken along line 16—16 in FIG. 11.

The port half 540 includes (see FIG. 11) a first or main section 600 which is mounted on the lower unit 14 and which has therein an opening 604 through which the electrical cable 450 extends. The port half 540 also includes (see FIGS. 11 and 16–18) a substantially smaller second section 610 located in the opening 604 in the main section 600. In the illustrated construction, as shown in FIG. 16, the opposite ends of the second section 610 are slideably received in vertically extending slots 614 in the main section 600. The second section 610 has therein first and second or fuel and oil apertures, 618 and 622, respectively, the reason for which is explained hereinafter.

The cowl assembly 500 also includes means for removably securing the second section 610 of the port half 540 to the main section 600 of the port half 540 so as to clamp the electrical cable 450 between the sections 600 and 610. Preferably, a seal 630 (FIG. 19) is provided between the electrical cable 450 and the sections 600 and 610 of the port half 540. While various suitable securing means can be used, in the illustrated construction (see FIGS. 16, 17 and 19), the second section 610 has thereon an inwardly extending tab 634, and the securing means includes a screw 638 which extends downwardly through the tab 634 and which is threaded into the main section 600.

Figure 12:
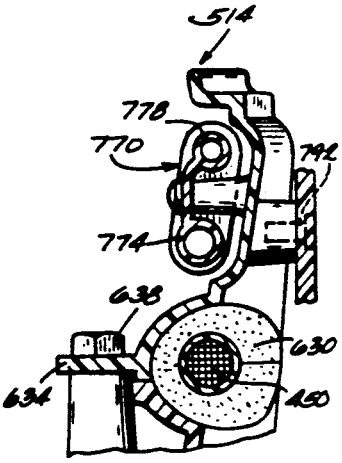
FIG. 12 is a view taken along line 12—12 in FIG. 11.
Figure 15:
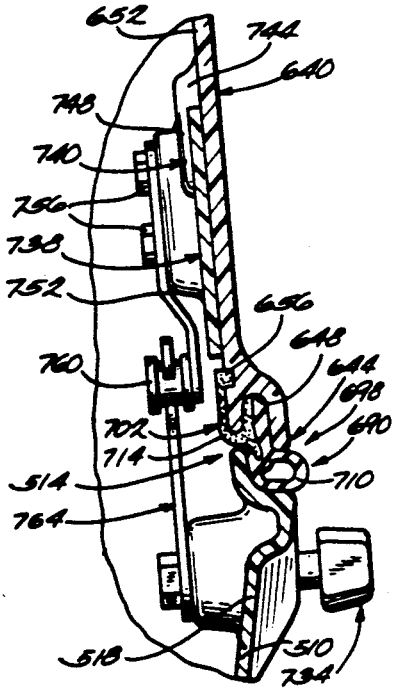
FIG. 15 is a view taken along line 15—15 in FIG. 14.
Figure 18:
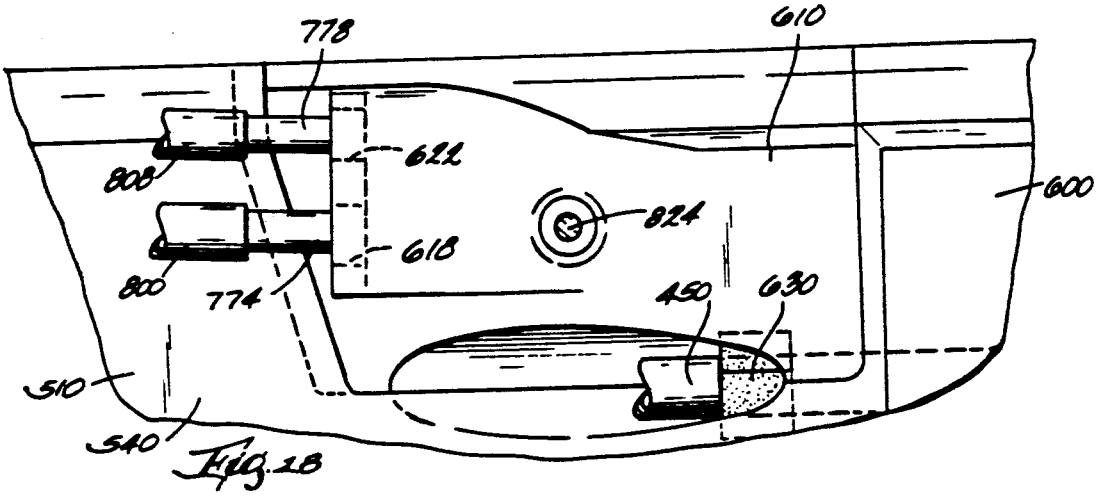
FIG. 18 is a view taken along line 18—18 in FIG. 16.
Figure 17:
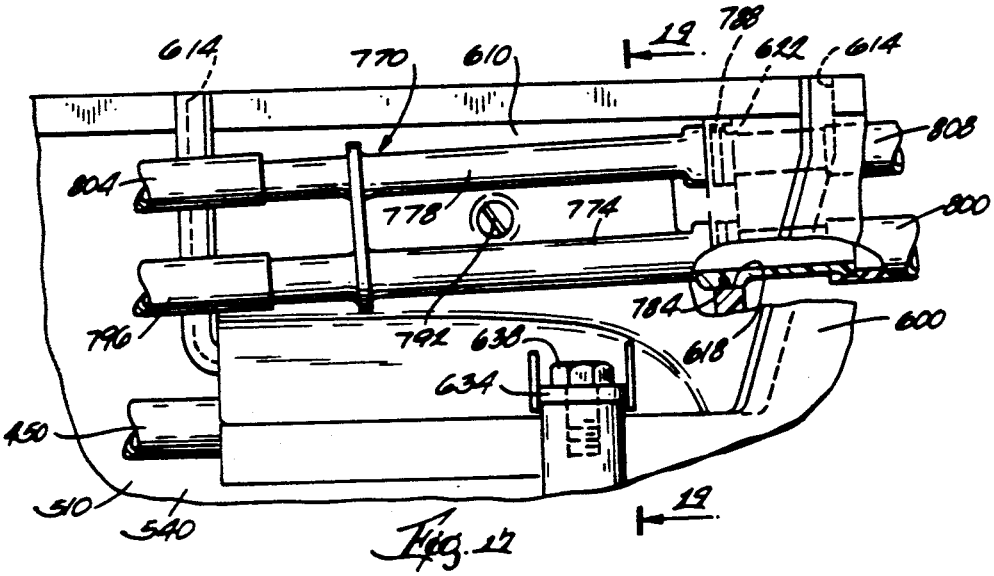
FIG. 17 is a view taken along line 17—17 in FIG. 16.

The cowl assembly 500 also includes (see FIGS. 2, 15 and 20) a dome-shaped upper cover member 640. The upper cover member 640 has an endless lower end 644 having therein (see FIGS. 15 and 20) an upwardly extending recess 648. The upper cover member 640 also has a generally vertical inner surface 652 having therein an endless recess 656 extending generally parallel to the lower end 644 of the upper cover member 640. The upper cover member 640 includes (see FIG. 12) port and starboard side walls 660 and 664. Each of the side walls has therein (see FIG. 11) an air intake opening 668 located adjacent the upper rear corner thereof. Each air intake opening 668 has therein a louvered grill 672 including forwardly angled vanes 676 which facilitate air flow into the intake opening 688 when the marine propulsion device 10 is moving forwardly.

The upper cover member 640 also includes (see FIG. 12) port and starboard baffles 680 and 684 bonded to the inner surface of the upper cover member 640. Each baffle cooperates with the upper cover member 640 to form a duct 688 having an upper end communicating with the associated air intake opening 668 and having a lower end opening adjacent the lower end of the upper cover member 640. When the upper cover member 640 is secured to the lower cover member 510, the ducts 688 conduct air to the lower portion of the cowl assembly 500. The air then flows to the engine induction system, but any water entrained with the air as the air flows through the ducts 688 is deposited into the lower cover member 510 and drained through the conduit 580. Keeping water off the engine 30 reduces corrosion of engine components. Because the ducts 688 open into a relatively quiet area within the cowl assembly 500, noise emission from the air intake openings 668 is reduced. Furthermore, the sound level of certain frequencies can be reduced by adjusting the lengths of the ducts 688.

The cowl assembly 500 further includes (see FIGS. 15 and 20) an endless seal 690 located between the upper end of the lower cover member 510 and the lower end of the upper cover member 640. The seal 690 includes (see FIG. 20) an upwardly extending portion 694 extending into the upwardly extending recess 648 in the lower end of the upper cover member 640. The seal 690 also includes a relatively soft section 698 and a relatively hard section 702, which sections are preferably coextruded. In the illustrated construction, the soft section 698 of the seal 690 includes an upper portion 706 partially defining the upwardly extending portion 694 of the seal 690, and a hollow lower portion 710 located between the upper end of the lower cover member 510 and the lower end of the upper cover member 640. The hard section 702 of the seal 690 is generally U-shaped and includes a base portion 714 located beneath the lower end of the upper cover member 640. The hard section 702 also includes an inner leg 718 extending along the inner surface of the upper cover member 640, having a lower end connected to the base portion 714, and having an upper end having thereon a projection 722 extending inwardly and into the recess 656. The hard section 702 also includes an outer leg 726 having a lower end connected to the base portion 714, extending upwardly into the upwardly extending recess 648, and partially defining the upwardly extending portion 694 of the seal 690.

The cowl assembly 500 also includes interengaging means on the seal 690 and on the upper cover member 640 for securing the seal 690 to the upper cover member 640. While various suitable interengaging means can be used, in the illustrated construction, such means includes the recess 656 in the upper cover member 640 and the projection 722 on the hard section 702 of the seal 690. The projection 722 snaps into the recess 656 when the upwardly extending portion 694 of the seal 690 is inserted into the recess 648 in the lower end of the upper cover member 640.

Thus, the cowl assembly 500 includes means for securing the hard section 702 of the seal 690 to the upper cover member 640. While such means preferably includes interengaging means on the seal 690 and on the upper cover member 640, such means can alternatively include other suitable means for connecting the hard section 702 of the seal 690 to the upper cover member 640.

The cowl assembly 500 also includes (see FIG. 2) means for releasably securing the upper cover member 640 to the lower cover member 510 and for compressing the seal 690 between the upper end of the lower cover member 510 and the lower end of the upper cover member 640. In the illustrated construction, the securing means includes a front latch mechanism 730 located in the front of the cowl assembly 500 and a rear latch mechanism 734 located in the rear of the cowl assembly 500. The latch mechanisms 730 and 734 are substantially identical, and only the rear latch mechanism 734 will be described in detail.

Figure 14:
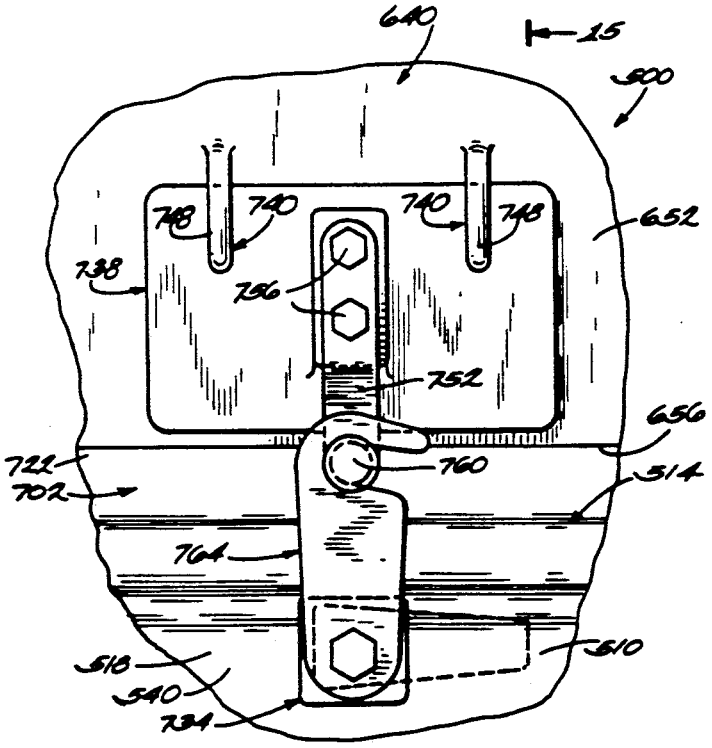
FIG. 14 is a view taken along line 14—14 in FIG. 12.

The latch mechanism 734 includes (see FIGS. 14 and 15) a bracket 738 bonded to the inner surface 652 of the upper cover member 640, and means for locating the bracket 738 relative to the upper cover member 640 prior to bonding of the bracket 738 to the upper cover member 640. Such locating means preferably includes a pair of locating ribs 740 on the inner surface 652 of the upper cover member 640. Each of the ribs 740 includes an inner portion 744 extending inwardly of the cowl assembly 500 from the surface 652, and an outer portion 748 which extends downwardly from the inner portion 744 and which is generally parallel to and spaced from the surface 652. The upper end of the bracket 738 engages the inner portions 744 of the ribs 740 and extends between the outer portions 748 of the ribs 740 and the inner surface 652 of the upper cover member 640. The ribs 740 limit upward movement of the bracket 738 relative to the upper cover member 640 and substantially prevent movement of the bracket 738 away from the surface 652 of the upper cover member 640. If desired, the upper end of the bracket 738 can have therein slots (not shown) which receive the inner portions 744 of the ribs 740 so as to locate the bracket 738 in lateral relation to the upper cover member 640. The bracket 738 is preferably bonded to the ribs 740 as well as to the inner surface 652 of the upper cover member 640.

The latch mechanism 734 also includes means for releasably securing the bracket 738 to the lower cover member 510. Such securing means preferably includes a member 752 having an upper end fixedly secured to the bracket 738 by suitable means such as screws 756. The member 752 has a lower end having thereon an inwardly extending pin 760. The means for securing the bracket 738 to the lower cover member 510 also includes a latch hook 764 pivotally mounted on one of the halves of the lower cover member 510. The hook 764 is movable between a released position and a secured position. Movement of the hook 764 from the released position to the secured position while the upper cover member 640 is seated on the lower cover member 510 causes camming engagement of the pin 760 by the hook 764 and thereby releasably secures the upper cover member 640 to the lower cover member 510 and compresses the seal 690 between the cover members 510 and 640.

The marine propulsion device 10 further comprises (see FIGS. 13 and 16–18) a fuel and oil conduit assembly 770 including a fuel conduit 774 and an oil conduit 778. The fuel conduit 774 extends through the fuel aperture 618 in the second section 610 of the port half 540 and has an inner end located inside the cowl assembly 500 and an outer end located outside the cowl assembly 500. An O-ring 784 surrounds the fuel conduit 774 and sealingly engages the second section 610 so as to seal the fuel aperture 618. The oil conduit 778 extends through the oil aperture 622 in the second section 610 and has an inner end located inside the cowl assembly 500 and an outer end located outside the cowl assembly 500. An O-ring 788 surrounds the oil conduit 778 and sealingly engages the second section 610 so as to seal the oil aperture 622.

The marine propulsion device 10 further comprises means for removably securing the fuel and oil conduit assembly 770 to the second section 610 of the port half 540. Such means preferably includes (see FIGS. 16 and 17) a screw 792 extending horizontally through the assembly 770 and into the second section 610.

The marine propulsion device 10 further comprises (see FIGS. 13 and 16–18) an inner fuel hose 796 connected between the engine 30 and the inner end of the fuel conduit 774, an outer fuel hose 800 connected between the outer end of the fuel conduit 774 and a remote fuel source (not shown), an inner oil hose 804 connected between the engine 30 and the inner end of the oil conduit 778, and an outer oil hose 808 connected between the outer end of the oil conduit 778 and a remote oil source (not shown). Fuel is supplied to the engine via the outer fuel house 800, the fuel conduit 774 and the inner fuel hose 796. Oil is supplied to the engine 30 via the outer oil hose 808, the oil conduit 778 and the inner oil hose 804.

The marine propulsion device 10 further comprises (see FIGS. 13 and 16) a mesh sheath 810 surrounding the electrical cable 450, the outer fuel hose 800, and the outer oil hose 808. The sheath 810 keeps the electrical cable 450 and the hoses 800 and 808 in a controlled bundle, provides an organized appearance, and provides abrasion resistance.

The marine propulsion device 10 further comprises (see FIGS. 13 and 16) a rigid duct 820 extending exteriorly of the cowl assembly 500 and surrounding the electrical cable 450, the outer fuel hose 800, and the outer oil hose 808. The duct 820 may or may not surround the end of the mesh sheath 810. The marine propulsion device 10 further comprises means for removably securing the duct 820 to the port half 540 of the lower cover member 510. While various suitable means can be employed, in the preferred embodiment, this means includes means for removably securing the duct 820 to the second section 610. Such securing means preferably includes a screw 824 which extends through the duct 820 and which is threaded into the second section 610. The means for securing the duct 820 to the port half 540 of the lower cover member 510 preferably also includes means for removably securing the duct 820 to the main section 600. Such means preferably includes a slot or recess 828 in the main section 600 and a projection 832 which is located on the duct 820 and which is removably received in the slot 828.

The marine propulsion device 10 further comprises (see FIGS. 11 and 13) a flexible bellows 840 surrounding the sheath 810 (and thus the electrical cable 450, the outer fuel hose 800, and the outer oil hose 808), and means for removably securing the bellows 840 to the duct 820. In the illustrated construction (see FIG. 13), the inner end of the bellows 840 has therein an endless recess 844, and the outer end of the duct 820 has thereon an endless, inwardly extending flange 848 received in the recess 844. The duct 820 further comprises short inwardly extending legs 900 which hold in place an annular retaining ring 902 which captures the inner end of the bellows 840 against the flange 848.

Various features of the invention are set forth in the following claims.

We claim:

1. A marine propulsion device comprising a lower unit, a propeller shaft rotatably supported by said lower unit and adapted to support a propeller, an engine supported by said lower unit and drivingly connected to said propeller, said engine including an engine block, and a throttle arm movably mounted on said engine block, a control cable operably connected to said throttle arm, means for removably securing said control cable to said engine block, and a cowl assembly surrounding said engine and including a pan-like lower cover member and a dome-shaped upper cover member, one of said cover members having therein an access opening extending therethrough, and means for affording access to said means for securing said control cable to said engine block, said affording means including said access opening, and an access cover removably secured to one of said cover members in covering relation to said access opening.

2. A marine propulsion device as set forth in claim 1 and further comprising a grommet through which said control cable extends, which is located in said access opening, and which is clamped between said access cover and said cover member.

3. A marine propulsion device as set forth in claim 1 wherein said lower cover member has therein a drain opening, and wherein said marine propulsion device further comprises a U-shaped drain conduit including a lower portion, a first leg extending upwardly from said lower portion and communicating with said drain opening, and a second leg extending upwardly from said lower portion and communicating with the atmosphere.

4. A marine propulsion device comprising a lower unit, a propeller shaft rotatably supported by said lower unit and adapted to support a propeller, an engine supported by said lower unit and drivingly connected to said propeller, a cowl assembly surrounding said engine and including a pan-like lower cover member having therein a drain opening, and a U-shaped drain conduit including a lower portion, a first leg extending upwardly from said lower portion and communicating with said drain opening, and a second leg extending upwardly from said lower portion and communicating with the atmosphere.

5. A marine propulsion device comprising a lower unit, a propeller shaft rotatably supported by said lower unit and adapted to support a propeller, an engine supported by said lower unit and drivingly connected to said propeller, an electrical cable operably connected to said engine, a cowl assembly surrounding said engine and including a first section which is mounted on said lower unit and which has therein an opening through which said electrical cable extends, and a second section located in said opening, and means for removably securing said second section to said first section so as to clamp said electrical cable between said first and second sections.

6. A marine propulsion device as set forth in claim 5 wherein said second section has therein first and second apertures, and wherein said device further comprises a fuel and oil conduit assembly including a fuel conduit extending through said first aperture and having an inner end located inside said cowl assembly and an outer end located outside said cowl assembly, and an oil conduit extending through said second aperture and having an inner end located inside said cowl assembly and an outer end located outside said cowl assembly, means for removably securing said fuel and oil conduit assembly to said second section of said cowl assembly, an inner fuel hose connected between said engine and said inner end of said fuel conduit, an outer fuel hose connected to said outer end of said fuel conduit, an inner oil hose connected between said engine and said inner end of said oil conduit, and an outer oil hose connected to said outer end of said oil conduit.

7. A marine propulsion device as set forth in claim 6 and further comprising a rigid duct extending exteriorly of said cowl assembly and surrounding said electrical cable, said outer fuel hose, and said outer oil hose, means for removably securing said duct to said second section, a flexible bellows surrounding said electrical cable, said outer fuel hose, and said outer oil hose, and means for removably securing said bellows to said duct.

8. A marine propulsion device as set forth in claim 5 wherein said engine includes an engine block, and a throttle arm movably mounted on said engine block, wherein said marine propulsion device further comprises a control cable operably connected to said throttle arm, and means for removably securing said control cable to said engine block, and wherein said cowl assembly includes means for affording access to said means for securing said control cable to said engine block.

9. A marine propulsion device as set forth in claim 8 wherein said cowl assembly includes a cover member having therein an access opening, and wherein said affording means includes said access opening, and an access cover removably secured to said cover member in covering relation to said access opening.

10. A marine propulsion device as set forth in claim 9 and further comprising a grommet through which said control cable extends, which is located in said access opening, and which is clamped between said access cover and said cover member.

11. A marine propulsion device as set forth in claim 5 wherein said cowl assembly includes a pan-like lower cover member having therein a drain opening, and wherein said marine propulsion device further comprises a U-shaped drain conduit including a lower portion, a first leg extending upwardly from said lower portion and communicating with said drain opening, and a second leg extending upwardly from said lower portion and communicating with the atmosphere.

12. A marine propulsion device comprising a lower unit, a propeller shaft rotatably supported by said lower unit and adapted to support a propeller, an engine supported by said lower unit and drivingly connected to said propeller, a cowl assembly surrounding said engine and including a first section which is mounted on said lower unit and which has therein an opening, and a second section which is located in said opening and which has therein an aperture, means for removably securing said second section to said first section, a fluid conduit extending through said aperture and having an inner end located inside said cowl assembly and an outer end located outside said cowl assembly, means for removably securing said fluid conduit to said second section of said cowl assembly, an inner hose connected between said engine and said inner end of said conduit, an outer hose connected to said outer end of said conduit, a rigid duct extending exteriorly of said cowl assembly and surrounding said outer hose, means for removably securing said duct to said second section, a flexible bellows surrounding said outer hose, and means for removably securing said bellows to said duct.

13. A marine propulsion device as set forth in claim 12 wherein said engine includes an engine block, and a throttle lever movably mounted on said engine block, wherein said marine propulsion device further comprises a control cable operably connected to said throttle lever, and means for removably securing said control cable to said engine block, and wherein said cowl assembly includes means for affording access to said means for securing said control cable to said engine block.

14. A marine propulsion device as set forth in claim 13 wherein said cowl assembly includes a cover member having therein an access opening, and wherein said affording means includes said access opening, and an access cover removably secured to said cover member in covering relation to said access opening.

15. A marine propulsion device as set forth in claim 14 and further comprising a grommet through which said control cable extends, which is located in said access opening, and which is clamped between said access cover and said cover member.

16. A marine propulsion device as set forth in claim 12 wherein said cowl assembly includes a pan-like lower cover member having therein a drain opening, and wherein said marine propulsion device further comprises a U-shaped drain conduit including a lower portion, a first leg extending upwardly from said lower portion and communicating with said drain opening, and a second leg extending upwardly from said lower portion and communicating with the atmosphere.

17. A marine propulsion device comprising a lower unit, a propeller shaft rotatably supported by said lower unit and adapted to support a propeller, an engine supported by said lower unit and drivingly connected to said propeller, an electrical cable operably connected to said engine, a cowl assembly surrounding said engine and including a first section which is mounted on said lower unit and which has therein an opening through which said electrical cable extends, and a second section which is located in said opening and which has therein first and second apertures, means for removably securing said second section to said first section so as to clamp said electrical cable between said first and second sections, a fuel and oil conduit assembly including a fuel conduit extending through said first aperture and having an inner end located inside said cowl assembly and an outer end located outside said cowl assembly, and an oil conduit extending through said second aperture and having an inner end located inside said cowl assembly and an outer end located outside said cowl assembly, means for removably securing said fuel and oil conduit assembly to said second section of said cowl assembly, an inner fuel hose connected between said engine and said inner end of said fuel conduit, an outer fuel hose connected to said outer end of said fuel conduit, an inner oil hose connected between said engine and said inner end of said oil conduit, an outer oil hose connected to said outer end of said oil conduit, a rigid duct extending exteriorly of said cowl assembly and surrounding said electrical cable, said outer fuel hose, and said outer oil hose, means for removably securing said duct to said second section, a flexible bellows surrounding said electrical cable, said outer fuel hose, and said outer oil hose, and means for removably securing said bellows to said duct.

18. A marine propulsion device as set forth in claim 17 wherein said engine includes an engine block, and a throttle arm movably mounted on said engine block, wherein said marine propulsion device further comprises a control cable operably connected to said throttle arm, and means for removably securing said control cable to said engine block, and wherein said cowl assembly includes means for affording access to said means for securing said control cable to said engine block.

19. A marine propulsion device as set forth in claim 18 wherein said cowl assembly includes a cover member having therein an access opening, and wherein said affording means includes said access opening, and an access cover removably secured to said cover member in covering relation to said access opening.

20. A marine propulsion device as set forth in claim 19 and further comprising a grommet through which said control cable extends, which is located in said access opening, and which is clamped between said access cover and said cover member.

21. A marine propulsion device as set forth in claim 17 wherein said cowl assembly includes a pan-like lower cover member having therein a drain opening, and wherein said marine propulsion device further comprises a U-shaped drain conduit including a lower portion, a first leg extending upwardly from said lower portion and communicating with said drain opening, and a second leg extending upwardly from said lower portion and communicating with the atmosphere.

22. A marine propulsion device as set forth in claim 1 wherein said control cable has an end operably connected to said throttle arm and located interiorly of said upper and lower cover members.

23. A marine propulsion device as set forth in claim 1 wherein said means for removably securing said control cable to said engine block is remote from said throttle arm and is independent of said cowl assembly.

* * * * *